US011180996B2

(12) United States Patent
Brady et al.

(10) Patent No.: US 11,180,996 B2
(45) Date of Patent: Nov. 23, 2021

(54) THERMAL BARRIER COATED VEHICLE TURBOCHARGER TURBINE WHEEL

(71) Applicant: GM GLOBAL TECHNOLOGY OPERATIONS LLC, Detroit, MI (US)

(72) Inventors: Grant W. Brady, Howell, MI (US); Chijou Wang, Farmington Hills, MI (US); Julie A. Swartz, Commerce Township, MI (US); Su Jung Han, West Bloomfield, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 42 days.

(21) Appl. No.: 16/661,203

(22) Filed: Oct. 23, 2019

(65) Prior Publication Data

US 2021/0123346 A1 Apr. 29, 2021

(51) Int. Cl.
*F01D 5/02* (2006.01)
*F01D 5/28* (2006.01)

(52) U.S. Cl.
CPC ..... *F01D 5/021* (2013.01); *F01D 5/284* (2013.01); *F05D 2220/40* (2013.01); *F05D 2230/90* (2013.01)

(58) Field of Classification Search
CPC ..... F01D 5/021; F01D 5/284; F05D 2230/90; F05D 2220/40
See application file for complete search history.

(56) References Cited

U.S. PATENT DOCUMENTS

| | | | | |
|---|---|---|---|---|
| 4,907,947 | A * | 3/1990 | Hoppin, III | C22C 19/056 148/514 |
| 9,234,525 | B2 | 1/2016 | Voong et al. | |
| 2010/0215506 | A1 | 8/2010 | Heyes et al. | |
| 2014/0186174 | A1* | 7/2014 | Malfa | F01D 25/24 415/220 |
| 2018/0156064 | A1 | 6/2018 | Han et al. | |

FOREIGN PATENT DOCUMENTS

| | | | | |
|---|---|---|---|---|
| DE | 102017128511 A1 * | 6/2018 | | C04B 35/48 |

* cited by examiner

*Primary Examiner* — Jacob M Amick
*Assistant Examiner* — Charles J Brauch
(74) *Attorney, Agent, or Firm* — Vivacqua Crane, PLLC

(57) ABSTRACT

A turbine wheel for a turbocharger of a vehicle propulsion system includes a central hub and a plurality of blades extending outwardly from the central hub. Each of the blades defining an inducer section and an exducer section, and each of the blades including a first surface portion and a second surface portion. The first surface portion including a thermal barrier coating and the second surface portion free from the thermal barrier coating.

14 Claims, 4 Drawing Sheets

THERMAL BARRIER COATED VEHICLE TURBOCHARGER TURBINE WHEEL

FIELD

The present disclosure relates to a thermal barrier coated vehicle turbocharger turbine wheel.

INTRODUCTION

This introduction generally presents the context of the disclosure. Work of the presently named inventors, to the extent it is described in this introduction, as well as aspects of the description that may not otherwise qualify as prior art at the time of filing, are neither expressly nor impliedly admitted as prior art against this disclosure.

During a combustion cycle of an internal combustion engine (ICE), air/fuel mixtures are provided to cylinders of the ICE. The air/fuel mixtures are compressed and/or ignited and combusted to provide output torque. Many diesel and gasoline ICEs employ a supercharging device, such as an exhaust gas turbine driven turbocharger, to compress the airflow before it enters the intake manifold of the engine in order to increase power and efficiency. Specifically, a turbocharger is a centrifugal gas compressor that forces more air (i.e., oxygen) into the combustion chambers of the ICE than is otherwise achievable with ambient atmospheric pressure. The additional mass of oxygen-containing air that is forced into the ICE improves the engine's volumetric efficiency, allowing it to burn more fuel in a given cycle, and thereby produce more power.

SUMMARY

In an exemplary aspect, a turbine wheel for a turbocharger of a vehicle propulsion system includes a central hub and a plurality of blades extending outwardly from the central hub. Each of the blades defining an inducer section and an exducer section, and each of the blades including a first surface portion and a second surface portion. The first surface portion including a thermal barrier coating and the second surface portion free from the thermal barrier coating.

In another exemplary aspect, the first surface portion is positioned adjacent to the inducer section.

In another exemplary aspect, the first surface portion comprises less than fifty percent of the entire surface area of the turbine blade.

In another exemplary aspect, the thermal barrier coating includes a metallic bond coat applied to the first surface portion of each of the turbine blades, and a ceramic top coat applied over the metallic bond coat.

In another exemplary aspect, the thermal barrier coating further includes an interfacial layer between the metallic bond coat and the ceramic top coat.

In another exemplary aspect, the thermal barrier coating has a thermal impedance above a predetermined threshold.

Further areas of applicability of the present disclosure will become apparent from the detailed description provided below. It should be understood that the detailed description and specific examples are intended for purposes of illustration only and are not intended to limit the scope of the disclosure.

The above features and advantages, and other features and advantages, of the present invention are readily apparent from the detailed description, including the claims, and exemplary embodiments when taken in connection with the accompanying drawings.

BRIEF DESCRIPTION OF THE DRAWINGS

The present disclosure will become more fully understood from the detailed description and the accompanying drawings, wherein.

DETAILED DESCRIPTION

Figure 1:
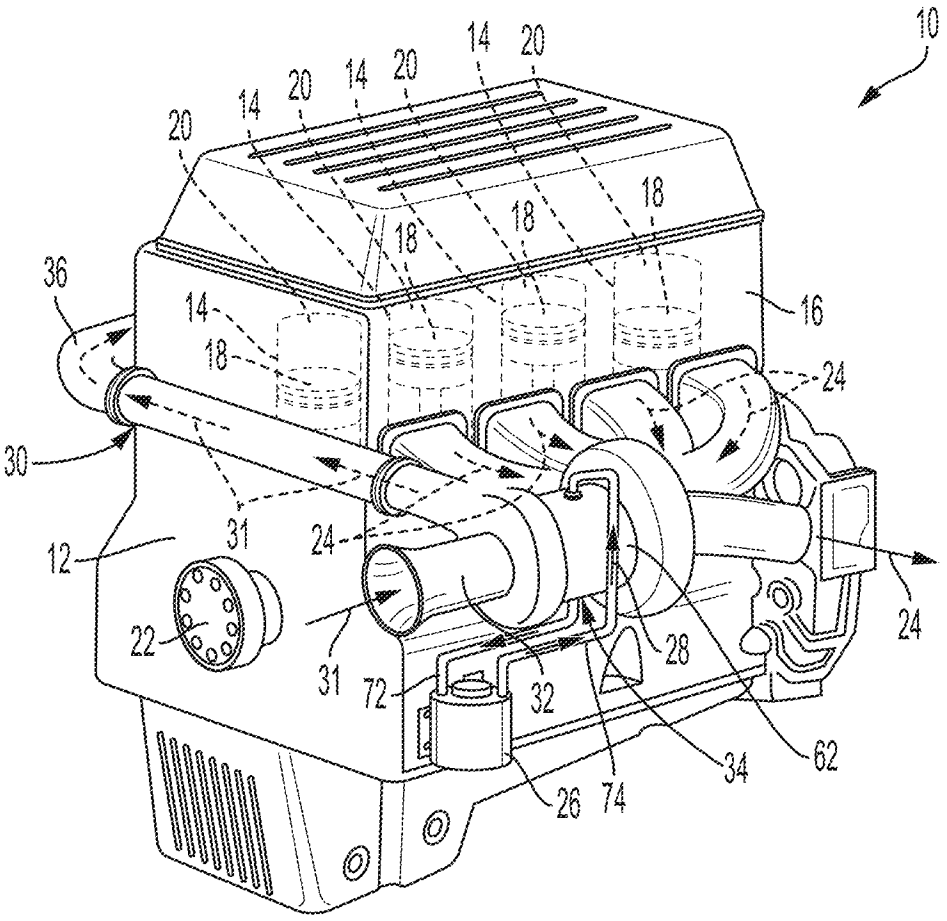
FIG. 1 is a schematic perspective view of an exemplary engine with a turbocharger, according to one or more embodiments.

Reference will now be made in detail to several examples of the disclosure that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, over, above, below, beneath, rear, and front, may be used with respect to the drawings. These and similar directional terms are not to be construed to limit the scope of the disclosure in any manner.

Referring now to the drawings, wherein like reference numbers correspond to like or similar components throughout the several figures, FIG. 1 illustrates an internal combustion engine 10. The engine 10 includes a cylinder block 12 with a plurality of cylinders 14 arranged therein. As shown, the engine 10 also includes a cylinder head 16. The engine 10 can be of a spark ignition or a compression ignition design. The engine 10 is illustrated as an inline four cylinder arrangement for simplicity. However, it is understood that the present teachings apply to any number of piston-cylinder arrangements and a variety of reciprocating engine configurations including, but not limited to, V-engines, inline engines, and horizontally opposed engines, as well as both overhead cam and cam-in-block configurations. Each cylinder 14 includes a piston 18 configured to reciprocate therein. Combustion chambers 20 are formed within the cylinders 14 between the bottom surface of the cylinder head 16 and the tops of the pistons 18. As known by those skilled in the art, combustion chambers 20 are configured to receive a fuel-air mixture for subsequent combustion therein.

The engine 10 also includes a crankshaft 22 configured to rotate within the cylinder block 12. The crankshaft 22 is rotated by the pistons 18 as a result of a fuel-air mixture being burned in the combustion chambers 20. After the air-fuel mixture is burned inside a specific combustion chamber 20, the reciprocating motion of a particular piston 18 serves to exhaust post-combustion gases 24 from the respective cylinder 14. The engine 10 also includes a fluid pump 26. The fluid pump 26 is configured to supply a lubricating fluid 28, such as engine oil. Accordingly, the fluid pump 26 may supply the lubricating fluid 28 to various bearings, such as that of the crankshaft 22. The fluid pump 26 may be driven directly by the engine 10, or by an electric motor (not shown).

The engine 10 additionally includes an induction system 30 configured to channel airflow 31 from the ambient to the cylinders 14. The induction system 30 includes an intake air duct 32, a turbocharger 34, and an intake manifold 36.

Although not shown, the induction system 30 may additionally include an air filter upstream of the turbocharger 34 for removing foreign particles and other airborne debris from the airflow 31. The intake air duct 32 is configured to channel the airflow 31 from the ambient to the turbocharger 34, and the turbocharger is configured to compress (i.e., pressurize) the received airflow 31, and discharge the compressed airflow to the intake manifold 36. The intake manifold 36, in turn, distributes the previously compressed airflow 31 to the cylinders 14 for mixing with an amount of fuel and subsequent combustion of the resultant fuel-air mixture.

Figure 2:
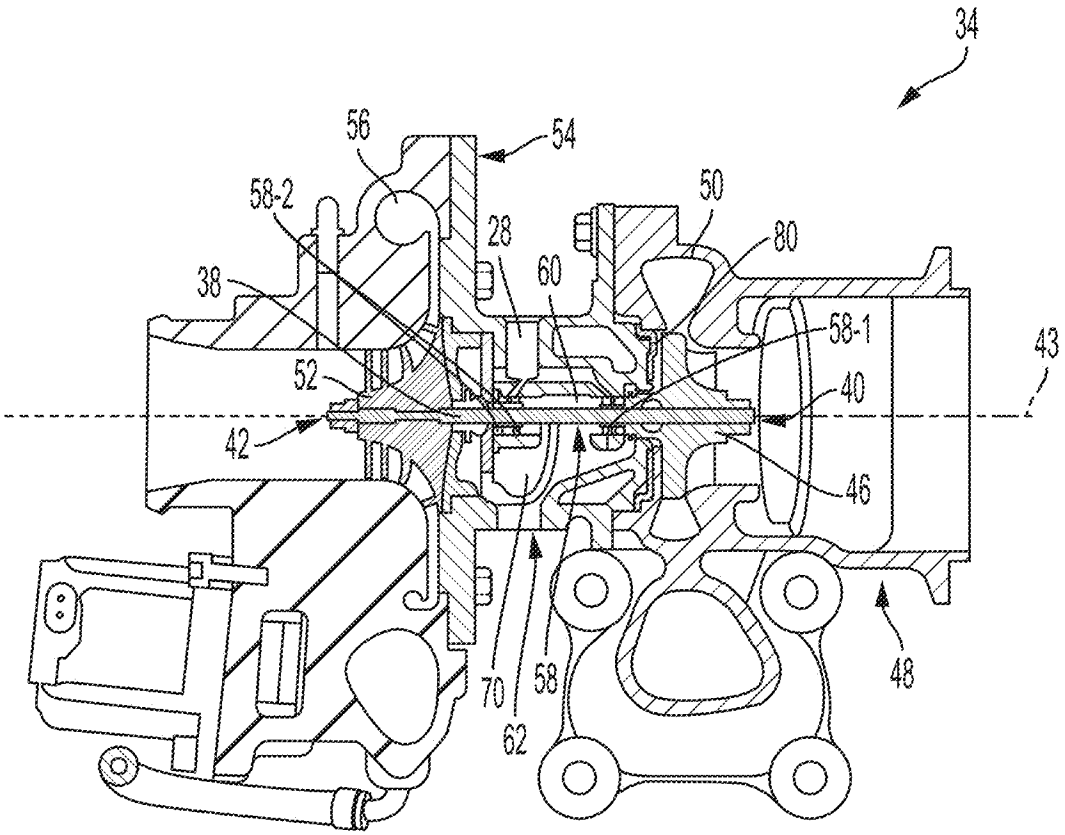
FIG. 2 is a schematic cross-sectional view of a turbocharger, according to one or more embodiments.

As shown in FIG. 2, the turbocharger 34, represented in simplified form for the sake of clarity, includes a turbine wheel 46 disposed within a turbine housing 48, a compressor wheel 52 disposed within a compressor housing 54, and a shaft 38 passing through a bearing housing 62 and operably connected to the turbine wheel 46 and the compressor wheel 52. The shaft 38 includes a first end 40 and a second end 42. As shown in FIG. 2, a heat shield 80 is disposed about the shaft 38 in a position between the bearing housing 62 and the turbine wheel 46. The heat shield 80 can be proximate to or contiguous with one or more of the turbine housing 48 and the bearing housing at one or more locations.

The turbine wheel 46 is mounted on the shaft 38 proximate to the first end 40 and configured to be rotated along with the shaft 38 about an axis 43 by post-combustion exhaust gases 24 emitted from the cylinders 14. The turbine wheel 46 is disposed inside the turbine housing 48 that includes a volute or scroll 50. The scroll 50 receives the post-combustion exhaust gases 24 and directs the exhaust gases to the turbine wheel 46. The scroll 50 can be configured to achieve specific performance characteristics, such as efficiency and response, of the turbocharger 34. In operation, the turbine wheel 46 captures kinetic energy from the post-combustion exhaust gases 24, and volumetric restrictions of the gases 24 within the turbine housing 48 convert thermal energy into additional kinetic energy. The heat shield 80 increases the efficiency of the turbine wheel 46 by preventing heat loss and maximizing the conversion of thermal energy into additional kinetic energy. The turbocharger 34 can optionally include a wastegate actuator (not shown) which diverts excess post-combustion exhaust gases 24 away from the turbine wheel 46 in order to limit the rotational speed of the turbine wheel 46.

As further shown in FIG. 2, the compressor wheel 52 is mounted on the shaft 38 proximate to the second end 42. Because the shaft 38 is common to the turbine wheel 46 and the compressor wheel 52, kinetic energy translated from the post-combustion exhaust gases 24 to the turbine wheel 46 imparts rotation to the common shaft 38 which is further communicated to the compressor wheel 52. The variable flow and force of the post-combustion exhaust gases 24 influences the amount of boost pressure that can be imparted to airflow 31 by the compressor wheel 52, and subsequently the amount of oxygen capable of being delivered to cylinders 14, throughout the operating range of the engine 10. The compressor wheel 52 is disposed within the compressor housing 54 that includes a volute or scroll 56. The scroll 56 receives the airflow 31 and directs the airflow to the compressor wheel 52. The scroll 56 can be configured to achieve specific performance characteristics, such as peak airflow and efficiency of the turbocharger 34. The compressor wheel 52 is configured to compress the airflow 31 being received from the ambient for eventual delivery to the cylinders 14. The temperature of airflow 31 is increased during compression by the compressor wheel 52 to the detriment of engine 10 efficiency and performance. During injection into the cylinders 14, a lower airflow 31 temperature is preferred because a higher oxygen density and volumetric fuel to air ratio increases volumetric efficiency the engine 10. Lower airflow 31 temperatures also reduces or eliminates predetonation (i.e., "engine knocking") of fuel prior to an intended spark-induced ignition. Accordingly, turbocharged engines typically include an intercooler (not shown) situated between the compressor housing 54 and the intake manifold 36 for cooling compressed airflow 31 prior to injection into the cylinders 14. The heat shield 80 increases the efficiency of the compressor wheel 52 by preventing or limiting heat transfer from the turbine wheel 46, the turbine housing 48, and/or the post-combustion exhaust gases to the airflow 31 prior to compression. Preventing or limiting heat transfer to the airflow 31 also reduces operational burden imposed on the intercooler, and further increases overall engine 10 efficiency.

A turbocharger operates based upon the recovery of energy from the exhaust stream. The amount of energy that is available to be recovered is measured in terms of enthalpy which is based upon the pressure, velocity, and temperature of the exhaust stream. An increase in any one of pressure, velocity, and temperature of the exhaust stream increases the enthalpy of the exhaust stream and, thus, the amount of energy that is available to be converted into rotational energy of the turbine wheel. Any increase in pressure, velocity, and/or temperature has been difficult to achieve. A major obstacle in achieving higher temperatures has been the materials that are used for turbine wheels have an operating temperature limit. This operating temperature limit directly limits the enthalpy of the exhaust stream flowing through the turbocharger, thereby, limiting the energy available to the turbocharger. Currently, turbine wheel operating temperatures are limited to no higher than between about 900 to 980 degrees Celsius. There is a need to further increase the exhaust stream temperatures above these temperature ranges and to further increase the capability of the turbine wheel to operate in exhaust stream temperatures above 1030 degrees Celsius. One material which has been used for turbine wheels for exhaust temperatures exceeding 1030 degrees Celsius is known as MAR-M246 which is a Nickel-base alloy. However, there are significant limitations to MAR-M246 including problems and challenges in the casting process, the cost of the material, the rotational inertia of a turbine wheel, and the like, without limitation. These problems adversely affect propulsion systems having MAR-M246 turbine wheels including increase CO2 emissions, drivability, fuel economy and the like.

Other conventional turbine wheel materials have an operating temperature limit of about 980 degrees Celsius. However, these turbine wheels have better operating characteristics which result in reduced rotational inertia, lower cost, and other improved physical characteristics. Conventional propulsion systems incorporating turbine wheels comprising these lower operating temperature materials have had compromise other operating parameters to prevent and/or reduce the exposure of these turbine wheels to exhaust stream temperatures that might exceed the operating temperature limit.

In stark contrast to the conventional turbine wheels, the turbine wheel of the present disclosure includes a thermal barrier coating on a targeted area of the turbine wheel. In an exemplary embodiment of the turbine wheel a thermal barrier coating is applied to an inducer area of the turbine wheel. The inventors of the present disclosure discovered that targeted application of a thermal barrier coating on a turbine wheel enables the turbine wheel to be exposed to higher exhaust stream temperatures that had previously been possible. Increase exhaust stream temperatures increase the enthalpy of that exhaust stream, thereby increasing the energy available to the turbocharger. Targeted application of a thermal barrier coating onto a turbine wheel in accordance with the present disclosure further enables lower temperature base materials to be used for the turbine wheel, thereby improving physical properties of the turbine wheel at higher exhaust stream temperatures, improved performance, reduced emissions, increased fuel economy, and reduced cost. For example, a turbine wheel material having an operating temperature limit of about 980 degrees Celsius and a thermal barrier coating applied to a targeted area may increase the capability of that turbine wheel to become exposed to exhaust gas temperatures that exceed 980 degrees Celsius thereby increasing the enthalpy of the exhaust stream without adversely affecting the physical properties of the turbine wheel.

The inventors of the present disclosure discovered that a targeted area for application of a thermal barrier coating may be defined by applying a temperature gradient across the turbine wheel during analysis and modeling of turbine wheel operation using computational fluid dynamic tools together with finite element analysis tools. Conventionally, those of ordinary skill in the art have not applied a temperature gradient which contemplates the flow of heat (heat flux through the turbine wheel) during modelling of the operation of a turbine wheel. Rather, and in stack contrast, conventional modelling and analysis has relied upon bulk average temperature estimation for the entire turbine wheel along with application of a safety factor to reduce the risk of localized overtemperatures. These conventional methods further only contemplate the flow and change in enthalpy of the exhaust stream flowing through the turbocharger and do not contemplate the flow of heat through the turbine wheel itself. In an exemplary aspect, the extent of the targeted area may be defined by any number of factors which are available as a result of modelling the operation of an exemplary turbine wheel while applying a temperature gradient to the modeled turbine wheel. For example, for any given turbine wheel material an upper temperature limit may be determined and only those areas which are at risk of exceeding the upper temperature should be covered by a thermal barrier coating. In this manner, the extent of the targeted area may be determined.

Further, this analysis may be combined with a model which incorporates a finite element analysis which structurally contemplates the flexing of the turbine wheel blades. Through this analysis, the inventors discovered that the exducer portion of the blades of the turbine wheel tend to flex and/or vibrate. The inventors understood that a thermal barrier coating tends to be brittle and will not be effective to remain on the surface of the turbine wheel blades adjacent to the exducer portions. Therefore, the inventors discovered that significant benefits may be achieved by only coating the surface of the turbine blade adjacent to the inducer section and not coat portions which approach the exducer portion of the turbine wheel blades.

The inventors further discovered the advantageous benefits of the exemplary turbine wheel in accordance with the present disclosure is further improved by the ability to refer to data relating to material properties across a range of temperatures. In the absence of material property data across a range of relevant temperatures there is no need to apply a temperature gradient across the turbine wheel during modeling and analysis. In general, less expensive materials which are more commonly available and used are generally more well understood in relation to their physical properties across a range of temperatures. In contrast, more expensive and more rare materials, such as very high temperature materials may not have sufficient data across a range of temperatures. Further, obtaining this data is expensive and time consuming. The exemplary turbine wheel of the present disclosure obviates this issue by enabling the use of lower cost, better understood materials.

With continued reference to FIG. 2, the shaft 38 is supported for rotation about the axis 43 via a bearing system 58, such as a hybrid journal bearing system or ball bearing system. The bearing system 58 is disposed within a bore 60 of the bearing housing 62 and is configured to control radial motion and vibrations of the shaft 38. The bearing system 58 can include one or more bearings, such as a first bearing 58-1 and a second bearing 58-2 as shown. As shown in FIG. 2, for the purposes of example, the first bearing 58-1 and the second bearing 58-2 are lubricated and cooled by the supply of lubricating fluid 28. Lubricating fluid 28 can be pressurized and supplied via the fluid pump 26 to the bearing housing 62. The bearing housing 62 may be cast from a robust material such as iron in order to provide dimensional stability to the bore 60 under elevated temperatures and loads during operation of the turbocharger 34. The first bearing 58-1 and the second bearing 58-2 can be formed from a relatively soft metal, such as brass or bronze, such that the majority of wear from any contact between the shaft 38 and the bearings, as well as between the housing 62 and the bearings, would be borne by the bearings.

During operation of the turbocharger 34, the pressurized lubricating fluid 28 from the fluid pump 26 is delivered to the bearing housing 62 and directed to the bearing system 58 to lubricate the bearings 58-1, 58-2 and reduce direct contact between the bearings 58-1, 58-2 and the shaft 38, and the bearing 58-2 and the housing 62. Reducing such contact extends useful life of the bearings, reduces frictional losses in the turbocharger 34, reduces noise, vibration, and harshness (NVH), and enhances response of the turbocharger during operation thereof. The bearing housing 62 includes a drain volume 70 for the lubricating fluid 28 that is supplied to the bearing housing from the fluid pump 26. The drain volume 70 is an inner reservoir incorporated into the bearing housing 62 and may have an as-cast shape. With resumed reference to FIG. 1, a discharge passage 72 removes oil from the bearing housing 62 following the lubrication of the bearing system 58 and the oil's collection within the drain volume 70. As also shown in FIG. 1, the discharge passage 72 is in fluid communication with the fluid pump 26 in order to return to the pump the oil from the drain volume 70. A supply passage 74 channels oil from the fluid pump 26 to the bearing housing 62, thus establishing continuous circulation of lubricating oil through the bearing housing during operation of the turbocharger 34. Heat soaking from the turbine housing 48 and turbine wheel 46 into the shaft 38 and proximate components (e.g., bearing housing 62, bearing system 58) can detrimentally raise the temperature high enough to degrade or coke the remaining lubricating fluid 28. The lubricating fluid 28 is particularly susceptible to coking after engine shutdown, for example. Coked lubricating fluid 28 can buildup in and/or plug one or more of the bearing system 58, fluid pump 26, and drain volume 70 such that subsequent lubricating fluid 28 flow lubrication and cooling is inhibited or prevented, and ultimately reduce turbocharger 34 and engine 10 performance.

Figure 3:
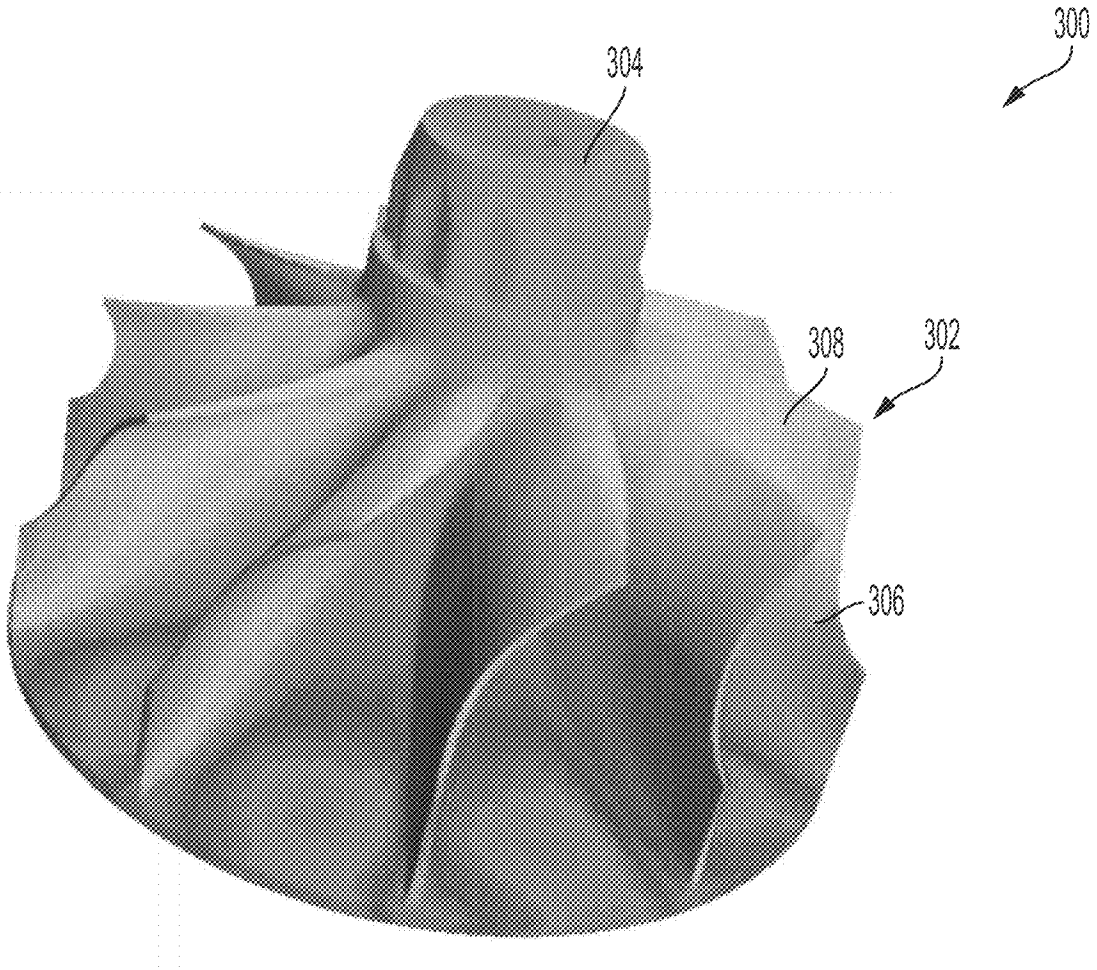
FIG. 3 illustrates the temperature gradient across a turbine wheel during operation of a turbocharger.

FIG. 3 illustrates a temperature gradient across an exemplary turbine wheel 300 during operation of a turbocharger. The turbine wheel 300 includes a plurality of blades 302 distributed about the periphery of a central rotary shaft 304. Each of the plurality of blades 302 includes an inducer section 306 and an exducer section 308. During operation of a turbocharger incorporating the turbine wheel 300, exhaust gases from an internal combustion engine encounter the turbine wheel 300 in a radially-inward direction and initially interact with the plurality of blades 302 at their respective inducer sections 306. As the exhaust gases flow through the turbocharger, the turbine wheel 300 converts a portion of the enthalpy energy of the exhaust gases into rotary motion. The plurality of blades 302 redirect the flow of the exhaust gases flowing through the turbocharger such that the exhaust gases exit the turbine wheel in a substantially axial direction and encounter the exducer section 308 of each of the plurality of blades 302 before exiting the turbocharger. By modelling the temperature gradient across the turbine wheel 300 the inventors discovered that the inducer section 306 of each of the plurality of blades 302 had the highest temperatures during operation. As a result of the inventors modeling the operation of the temperature gradient, the inventors discovered that only the inducer sections 306 of the turbine wheel needs to be protected from heat transfer from the exhaust stream to gain substantial benefits and advantages. In an exemplary embodiment of the present disclosure, the inducer sections of the turbine wheel may be protected by applying a thermal barrier coating only to the inducer sections. In this manner, targeted application of a thermal barrier coating to the inducer sections of the turbine wheel significantly reduces the transfer of heat into the turbine wheel which, in turn, enables significant benefits such as the ability to use lower cost materials for the turbine wheel and, an increase in exhaust stream temperatures being applied to the turbine wheel and the exposure time of that turbine wheel to those elevated temperatures.

Thermal barrier coatings (TBCs) are multilayered systems consisting of a low-thermal-conductivity ceramic top layer, a bond coat and an interfacial layer between the two. The protective thermal barrier coating system is deposited on the inducer section of the turbine blades. The first layer is a bond coat. The bond coat may be an oxidation-resistant metallic layer with high aluminum content, such as NiCoCrAlY or PtAl. The ceramic top layer may be a yttria-stabilized zirconia (YSZ), is deposited over the bond coat. A thermally grown oxide (TGO), predominantly alumina, forms and grows at the interface between the YSZ and bond coat during engine operation.

Exemplary processes for applying the thermal barrier coating system include electron beam vapor deposition (EB-PVD) and plasma spraying (PS). EB-PVD and PS yield significantly different coating microstructures, but both furnish the top coat with high porosity that imparts low thermal conductivity and high strain tolerance. The combination of bond coat and top coat layers protects the turbine blade substrates, allowing turbine inlet temperatures to reach about very high temperatures without adversely affecting the properties of the turbine blades.

Exemplary top coat materials for the thermal barrier coating system may include $Y_2O_3$—$ZrO_2$, $Gd_2Zr_2O_7$, $TiO_2$, Spinel, and $Al_2O_3$ for reducing materials cost. It is to be understood that a multi-layer structure will be required for $TiO_2$, and $Al_2O_3$ to overcome or reduce any thermal expansion mismatch with bondcoat layer. Thus, there may be trade off saving material cost but raising process cost. Also, in an exemplary thermal barrier coating a thicker layer may be needed than YSZ or $Gd_2Zr_2O_7$ to match the thermal barrier efficiency due to higher thermal conductivity than YSZ and $Gd_2Zr_2O_7$.

In an exemplary embodiment, the bond coat is a nickel-based metallic material, and can comprise an aluminum content of at least about 4% aluminum, at least about 5% aluminum, at least about 6% aluminum, at least about 7% aluminum, or at least about 8% aluminum. Unless as otherwise specified, percentages refer to a weight percent. The bond coat can comprise about 4% aluminum to about 9% aluminum, about 4.5% aluminum to about 8.5% aluminum, or about 5% aluminum to about 8% aluminum. In a specific embodiment the bond coat comprises about 5% aluminum. The bond coat can further comprise chromium. The bond coat can comprise about 10% chromium to about 36% chromium, about 15% chromium to about 30% chromium, about 15.5% chromium to about 25.5% chromium, or about 15% chromium to about 25% chromium. In some embodiments the bond coat can comprise up to about 36% chromium, up to about 30% chromium, up to about 25.5% chromium, or up to about 25% chromium. The bond coat can further comprise nickel. The bond coat can comprise about 4% nickel to about 10% nickel, about 5.5% nickel to about 8.5% nickel, or about 7% nickel. In some embodiments, the bond coat comprises an amount of aluminum as specified above, optionally an amount of chromium as specified above, and the balance comprising nickel.

TBCs can be deposited by electron beam-physical vapor deposition (EB-PVD) and thermal spray process techniques, for example. The bond coat can be deposited by high velocity oxy fuel (HVOF) spraying or plasma spraying (PS), for example. The bond coat can optionally include organics during the deposition phase. Nickel-based bond coat materials comprising one or more of aluminum and chromium, particularly those disclosed herein, can utilize powder or wire feedstocks for the spray deposition process. The feedstock material is injected into a high temperature pressurized flame or plasma, thereafter turning immediately into molten particles via exothermic reactions with surrounding atmosphere due to the high enthalpies of aluminum and/or chromium. These high temperature molten particles impinge to the substrate (e.g., the heat shield) and rapidly solidify with a high quenching rate (e.g., 10^6 K/s). The coating accumulates by subsequent impingement with the hot particles which allow metallurgical bonds to form with the previously deposited layer by diffusion within a short period time. The bond coat can have high resistance to oxidation, high roughness, and high porosity (e.g., about 4% to about 8% porosity). The bond coat can have a thickness of at least about 15 μm, at least about 20 μm, at least about 25 μm, or at least about 30 μm. The bond coat can have a thickness of up to about 150 μm, or greater than about 150 μm.

The interfacial layer is applied to the bond coat layer, and the ceramic layer is lastly applied to the interfacial layer. The ceramic layer comprises a low thermal conductivity ceramic. Suitable low thermal conductivity can defined as less than about 2 $kWm^{-1}K^{-1}$. Suitable ceramic materials can include yttria-stabilized zirconia (YSZ, e.g., $Y_2O_3$—$ZrO_2$), aluminum oxide (e.g., $Al_2O_3$), titanium oxide (e.g., $TiO_2$), gadolinium zirconate (e.g., $Gd_2Zr_2O_7$), and spinels ($MgAl_2O_4$). In particular, the ceramic can comprise titanium oxide, spinel, or aluminum oxide. Thermally sprayed aluminum oxide has been found to inherently contain microstructural defects, including voids, porosity (e.g., interlamellar and globular), and microcracks, which are generally considered to be undesirable. However, for the applications disclosed herein, such microstructural defects lower the thermal conductivity of aluminum oxide from about 3 $kWm^{-1}K^{-1}$ to acceptable levels. Therefore, the advantageous characteristics of aluminum oxide (e.g., weight) can be utilized without compromising thermal performance.

In some embodiments, the ceramic layer is free from yttria-stabilized zirconia and gadolinium zirconate. The ceramic layer can have high surface roughness. For example, the ceramic layer can have an average surface roughness (Ra) of at least about 9 μm. Additionally or alternatively, the ceramic layer can have a mean roughness depth (Rz) of at least about 50 μm. The ceramic layer can be deposited by EB-PVD or PS, for example. A suitable deposition method is one which imparts low thermal conductivity and high strain tolerance to the deposited ceramic. The ceramic layer can have a thickness of at least about 150 μm. The ceramic layer can have a thickness of up to about 500 μm, or greater than about 500 μm.

The interfacial layer comprises a mixture of the ceramic material from the ceramic layer and the material from the bond coat layer. For example, the interfacial layer can comprise about a 50%/50% blend of bond coat material/ceramic. The interfacial layer can comprise about a 10%/90% to about a 90%/10% blend of bond coat material/ceramic. In one embodiment, wherein the ceramic is YSZ, gadolinium zirconate, or spinel, the interfacial layer can comprise about a 40%/60% to about 60%/40% bondcoat material/ceramic blend. In some embodiments, the interfacial layer can comprise a plurality of blended layers of varying compositions. In embodiments wherein the interfacial layer comprises multiple blended layers, the concentration of the ceramic material in each of the blended layers can increase relative to the other blended layers with increased proximity to the ceramic top coat layer. Additionally or alternatively, in embodiments wherein the interfacial layer comprises multiple blended layers, the concentration of the bond coat material in each of the blended layers can increase relative to the other blended layers with increased proximity to the bond coat layer. In some embodiments, the interfacial layer is free from yttria-stabilized zirconia and gadolinium zirconate.

In one embodiment, wherein the ceramic is aluminum oxide or titanium oxide, the interfacial layer can include a plurality of interfacial subsections. In one embodiment having three interfacial subsections, interfacial subsection 1 can include about a 90%/10% to about 70%/30% bondcoat material/ceramic blend, interfacial subsection 2 can comprise about a 40%/60% to about 60%/40% bondcoat material/ceramic blend, and interfacial subsection 3 can comprise about a 10%/90% to about 70%/30% bondcoat material/ceramic blend. A larger thermal expansion disparity between the bond coat layer and ceramic layer can require more interfacial subsections. The interfacial layer can be at least about 10 μm. An interfacial subsection can be at least about 10 μm. In some embodiments, the ceramic layer can comprise a small amount of bondcoat layer material, such as less than about 5% bondcoat material.

Figure 4:
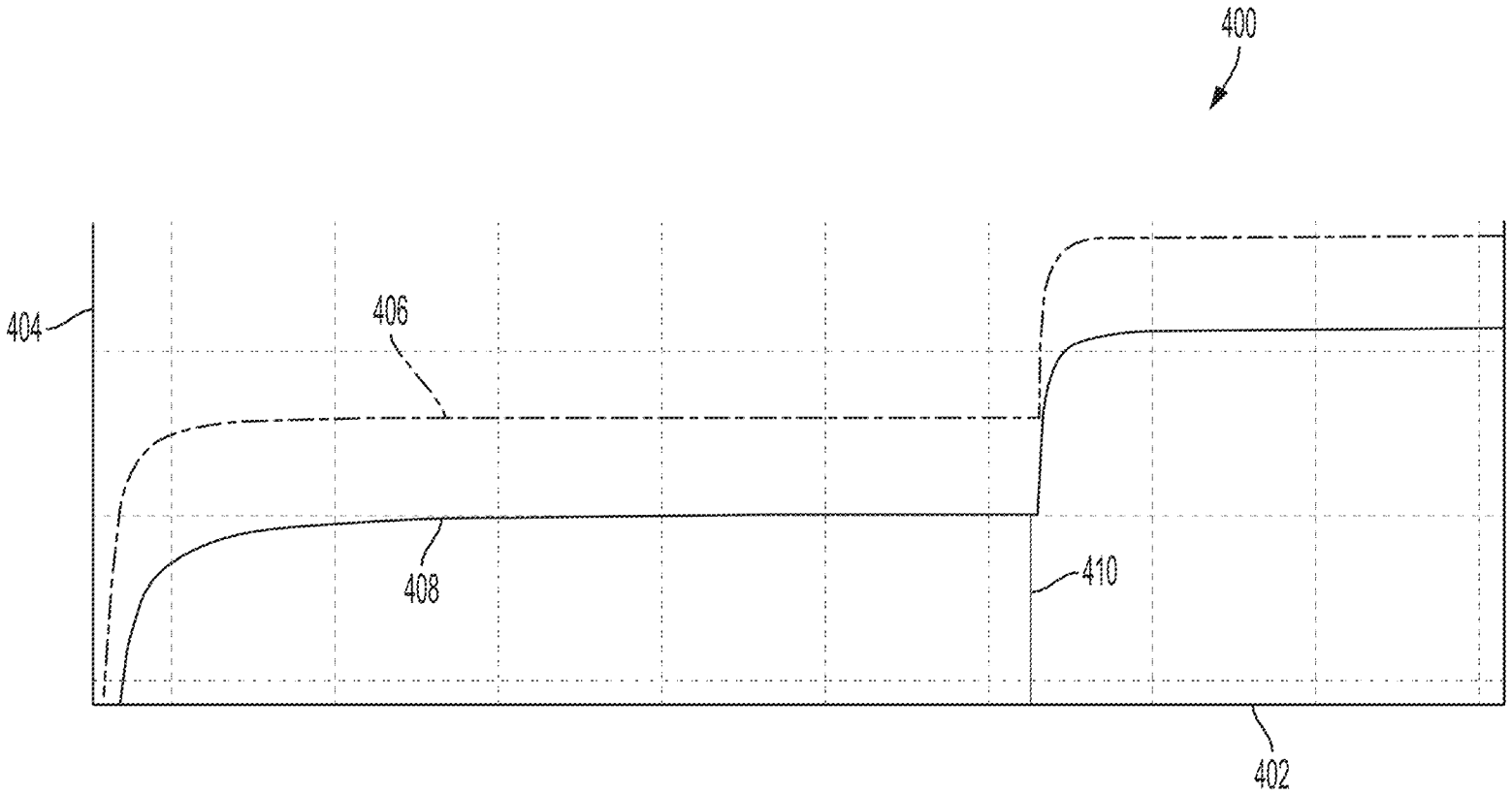
FIG. 4 is a graph illustrating a comparison of temperature history for two different turbine wheels.

FIG. 4 is a graph 400 illustrating a comparison of temperature history for two different turbine wheels. The horizontal axis 402 of the graph corresponds to the passage of time and the vertical axis 404 of the graph corresponds to the maximum temperature gradient for each of the turbine wheels. The first temperature maximum temperature gradient response 406 corresponds to the temperature response of a conventional turbine wheel and the second temperature maximum gradient response 408 corresponds to the temperature response of an exemplary turbine wheel in accordance with the present disclosure which includes a thermal barrier coating on an inducer section of the plurality of blades. The graph 400 illustrates that the maximum temperature for the conventional turbine wheel always exceeds the amplitude of the maximum temperature for the exemplary turbine wheel having a thermal barrier coating on an inducer section of the plurality of blades. This is true even when there is a significant increase in the temperature of the exhaust gases encountered by the turbine wheels at time 410.

This description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims.

What is claimed is:

1. A turbine wheel for a turbocharger of a vehicle propulsion system, the turbine wheel comprising:

a central hub; and a plurality of blades extending outwardly from the central hub, each of the blades defining an inducer section and an exducer section, wherein a thermal barrier coating is disposed only on a portion of the inducer section defined by applying a temperature gradient across the turbine wheel and analyzing an operation of the turbine wheel under the temperature gradient using finite element analysis and computational fluid dynamic tools.

2. The turbine wheel of claim 1, wherein the thermal barrier coating comprises:

a metallic bond coat applied to the first surface portion of each of the turbine blades; and a ceramic top coat applied over the metallic bond coat.

3. The turbine wheel of claim 2, wherein the thermal barrier coating further comprises an interfacial layer between the metallic bond coat and the ceramic top coat.

4. The turbine wheel of claim 1, wherein the thermal barrier coating has a thermal impedance above a predetermined threshold.

5. A turbocharger for a vehicle propulsion system, the turbocharger comprising:

a housing;

a compressor wheel rotatably supported on a shaft within the housing; and a turbine wheel having a central hub rotatably supported on the shaft within the housing and a plurality of blades extending outwardly from the central hub, each of the blades defining an inducer section and an exducer section, and the inducer section including a portion having a thermal barrier coating, wherein the portion is defined by applying a temperature gradient across the turbine wheel and analyzing an operation of the turbine wheel under the temperature gradient using finite element analysis and computational fluid dynamic tools and the exducer section free from the thermal barrier coating.

6. The turbocharger of claim 5, wherein the thermal barrier coating comprises:

a metallic bond coat applied to the first surface portion of each of the turbine blades; and a ceramic top coat applied over the metallic bond coat.

7. The turbocharger of claim 6, wherein the thermal barrier coating further comprises an interfacial layer between the metallic bond coat and the ceramic top coat.

8. The turbocharger of claim 5, wherein the thermal barrier coating has a thermal impedance above a predetermined threshold.

9. A method of manufacturing a turbine wheel for a turbocharger for a vehicle propulsion system, the turbine wheel including a central hub and a plurality of blades extending outwardly from the central hub, the plurality of blades each having an inducer section and an exducer section, the method comprising:

applying a temperature gradient across the turbine wheel;

analyzing an operation of the turbine wheel under the temperature gradient using finite element analysis and computational fluid dynamic tools; and applying a thermal barrier coating to a first surface portion of each of the blades and maintaining a second surface portion of each of the blades free from the thermal barrier coating based on the analysis of the operation of the turbine wheel under the temperature gradient.

10. The method of claim 9, wherein the first surface portion includes the inducer section and the second surface portion includes the exducer section.

11. The method of claim 10, wherein the first surface portion comprises less than fifty percent of the entire surface area of the turbine blade.

12. The method of claim 9, wherein applying the thermal barrier coating comprises:

applying a metallic bond coat applied to the first surface portion of each of the turbine blades; and applying a ceramic top coat over the metallic bond coat.

13. The method of claim 12, wherein applying the thermal barrier coating further comprises applying an interfacial layer on the metallic bond coat before applying the ceramic top coat.

14. The method of claim 9, wherein the thermal barrier coating has a thermal impedance above a predetermined threshold.

* * * * *